US005353533A

United States Patent [19]

Meade

[11] Patent Number: 5,353,533

[45] Date of Patent: Oct. 11, 1994

[54] IRONING BOARD AND LEG STRUCTURES FOR FLAT, COLLAPSED CONFIGURATION

[75] Inventor: Ronald G. Meade, Seaton, Australia

[73] Assignee: Hills Industries Limited, Edwardstown, Australia

[21] Appl. No.: 4,911

[22] Filed: Jan. 19, 1993

[30] Foreign Application Priority Data

Jan. 17, 1992 [AU] Australia ..... PL 0480

[51] Int. Cl.[5] ..... D06F 81/02; A47B 3/02

[52] U.S. Cl. ..... 38/103; 38/DIG. 2; 108/120

[58] Field of Search ..... 38/DIG. 1, DIG. 2, DIG. 3, 38/103, 137; 108/115, 118, 120, 121, 123, 127, 129, 131

[56] References Cited

U.S. PATENT DOCUMENTS

| | | | |
|---|---|---|---|
| 2,675,635 | 4/1954 | Toth | 38/DIG. 2 X |
| 2,721,907 | 10/1955 | Sutherland | 108/121 |
| 2,760,286 | 8/1956 | Voigt et al. | 38/DIG. 3 X |
| 2,908,984 | 10/1959 | Lantz | 38/DIG. 3 X |
| 3,069,719 | 12/1962 | Ridge | 108/120 X |
| 3,141,425 | 7/1964 | Duer | 108/128 |

FOREIGN PATENT DOCUMENTS

| | | | |
|---|---|---|---|
| 0244965 | 5/1963 | Australia | 38/DIG. 3 |
| 2165442 | 4/1986 | United Kingdom | 38/DIG. 2 |

*Primary Examiner*—Clifford D. Crowder
*Assistant Examiner*—Ismall Izaguirre
*Attorney, Agent, or Firm*—Edward W. Callan

[57] ABSTRACT

A improved collapsible ironing table assembly (10) of the type comprising a flat table top (11) having a peripheral framing member (12) extending therearound, a pair of spaced apart channels (13) extending longitudinally of the table top and secured to the underside surface thereof, and a pair of diagonally crossed pivotal support legs (17, 17') supporting the table top and movable between an extended working position and a retracted out-of-use position, the improvements being such that the table assembly can be collapsed to a compact approximately linear storage configuration in which the pivotal legs (17, 17') lie flat alongside one another nested essentially within the recess formed between the opposed channels (13) on the underside of the table top, the table when fully collapsed, having an overall depth which approximately equals the depth of the table top peripheral framing member.

6 Claims, 2 Drawing Sheets

IRONING BOARD AND LEG STRUCTURES FOR FLAT, COLLAPSED CONFIGURATION

This invention relates to improvements to ironing tables, and is particularly directed to an ironing table of the type having a flat elongate board supported on folding legs so that it can be stowed in a minimum of space for storage purposes and erected when required for use.

Ironing tables with folding legs are in common use and a typical ironing table is defined herein as comprising a flat table top having a peripheral framing member secured thereto, a pair of spaced apart intermediate channels extending longitudinally of the table top and secured to the underside surface thereof, the intermediate channels having vertical webs and parallel flanges the flanges of each channel being in the same planes as and facing the flanges of the other channel, a pair of diagonally-crossed pivotal support legs supporting the table top and movable between an extended position wherein the legs support the top in an elevated condition and a retracted out-of-use position where they occupy a position adjacent the underside of the table top, each leg being secured at one end thereof to a leg hinge member which extends between and is supported by the channels, one of said leg hinge members being guided for movement along the opposed channels.

One of the problems with existing ironing tables is their inability to collapse to a compact flat configuration so that they can be easily and conveniently handled in the collapsed condition and stowed in a minimum space. Existing tables, when in their collapsed condition, have their diagonally crossed legs located in a horizontal plane spaced from the underside surfaces of the table top. The effective height of the table, when thus collapsed, is the combined thicknesses of the table top and the leg. Thus the table as a whole occupies a space which is not conducive for efficient packaging and transportation thereof. When one considers the extent of today's transportation costs, it is desirable that the tables be designed to fold flat in a minimum of space so that an optimum number of tables can be packaged in any given space.

It is the main object of the present invention to provide improvements to a collapsible ironing table of the type defined hereinabove which will allow the table to be collapsed to a compact approximately linear storage configuration and, when thus collapsed, occupy a space significantly less than that of existing collapsible ironing tables, whereby for a given volume of space, a far greater number of tables can be packaged therein.

It is a further object of the present invention to provide an improved collapsible ironing table which can be more easily handled and stowed away in a minimum of space, in comparison to known ironing tables.

SUMMARY OF THE INVENTION

In its broadest form, this invention is directed to an ironing table assembly of the type defined hereinabove, wherein the peripheral framing member, the pivotal support legs and the leg hinge members are shaped and dimensioned and the assembly constructed and arranged so that it can be collapsed to a compact approximately co-planar storage configuration in which the diagonally-crossed pivotal legs assume an approximately horizontal position alongside one another, the major portions of the legs being nested approximately within the recess formed between the opposed channels on the underside of the table top. With the legs thus collapsed, their lower or outer surfaces are preferably approximately flush with the bottom surfaces of the lower flanges of the channels and also the bottom surfaces of the peripheral framing member. With this arrangement, the ironing table when in its collapsed condition, has an overall depth which approximately equals the depth of the table top.

Most preferably, each leg is approximately T-shaped, comprising an elongate leg member, the inner end of which is secured to a transverse hinge bar, whilst the outer end is joined to a horizontal cross-bar which provides stable support for the table, each leg, when the table is fully collapsed, having an outer end portion projecting a short distance beyond a respective end of the table top, the projecting end portion being approximately horizontally aligned with the table top.

Preferably each of the leg hinge bars is formed with a kinked portion which forms a recess having a width which is slightly larger than the diameter of the leg member, to thereby allow the leg member to locate horizontally between the opposed channels in close proximity to the underside surface of the table top. Each leg, when collapsed will have a portion, intermediate its ends, located in the recess forming kinked portion of the hinge bar of the other leg.

Preferably, the peripheral framing member is provided with recessed or cut-out portions extending inwardly from its lower edge at opposite ends of the ironing board, so as to allow each leg member to engage in a respective said recessed portion when in its fully collapsed position. Preferably, each leg member has a recessed leg portion adjacent its lower end which interfits with a respective said recessed portion on the peripheral framing member so that the leg can assume its approximately flat horizontal disposition when fully collapsed. The recessed portions are preferably formed by a metal crushing or crimping process.

Preferably a transversely extending channel shaped bridge member is secured to and extends between said channels intermediate the ends thereof, the bridge member having aligned cutout or recessed portions in its flanges in which the legs may locate to allow the pair of legs to assume their approximately flat horizontal disposition when fully collapsed. The bridge member is used to stiffen the construction of the ironing board.

Each leg may itself comprise dual leg members, instead of using a cross-bar in which case the peripheral framing member will need to have a pair of recessed portions at one or both of its ends to permit the free ends of the leg members to project horizontally beyond the table top periphery.

In order to more fully explain the present invention, to embodiments are described hereunder in some further detail with reference to and as illustrated in the accompanying drawings in which:

DESCRIPTION OF THE PREFERRED EMBODIMENTS

Figures 1, 1A:
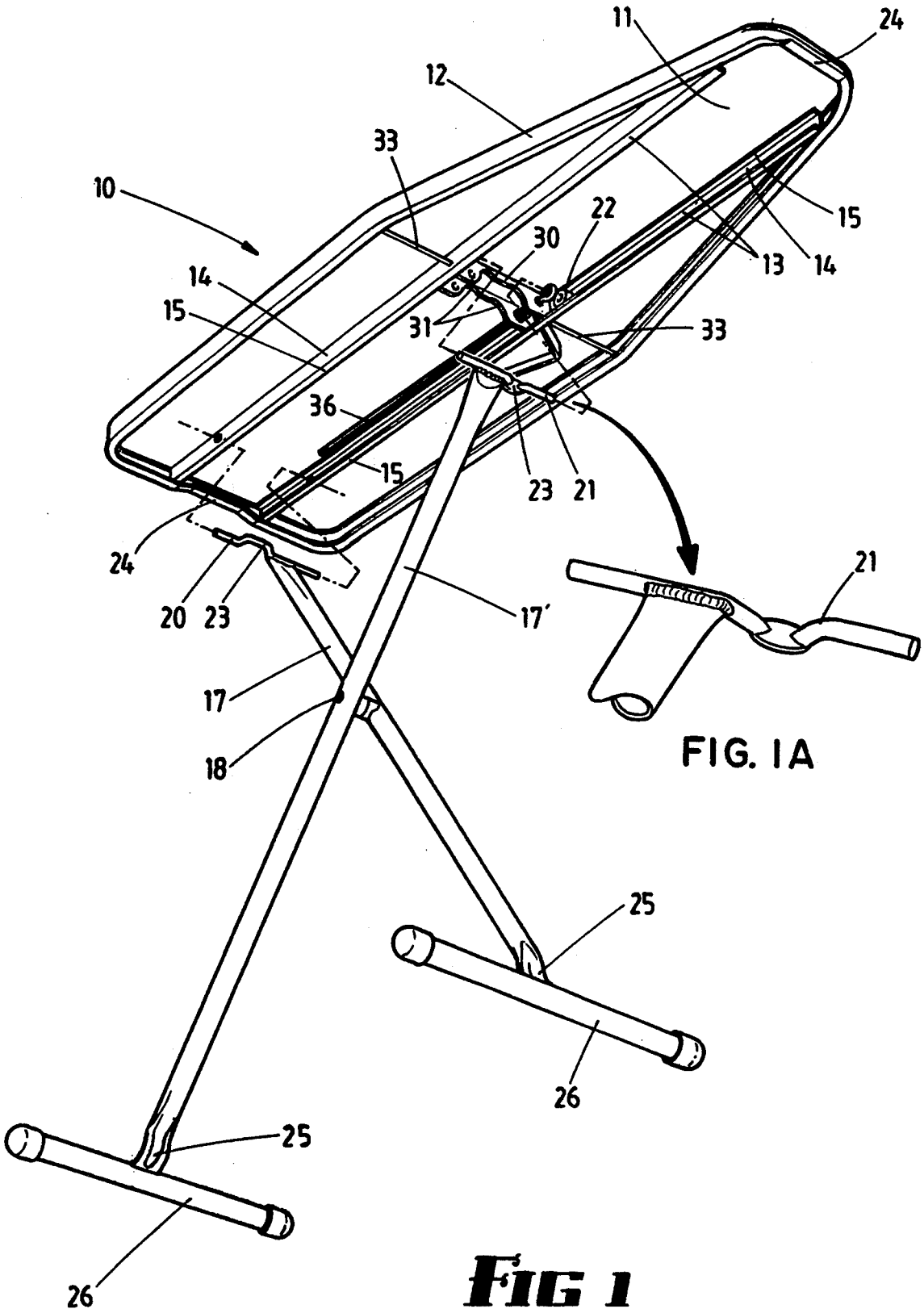
FIG. 1 is an exploded perspective view of an ironing table which incorporates the improvements according to a preferred embodiment of the invention.
FIG. 1A is a fragmentary enlarged view of a leg hinge bar secured to a leg in the ironing table shown in FIG. 1.
Figure 2:
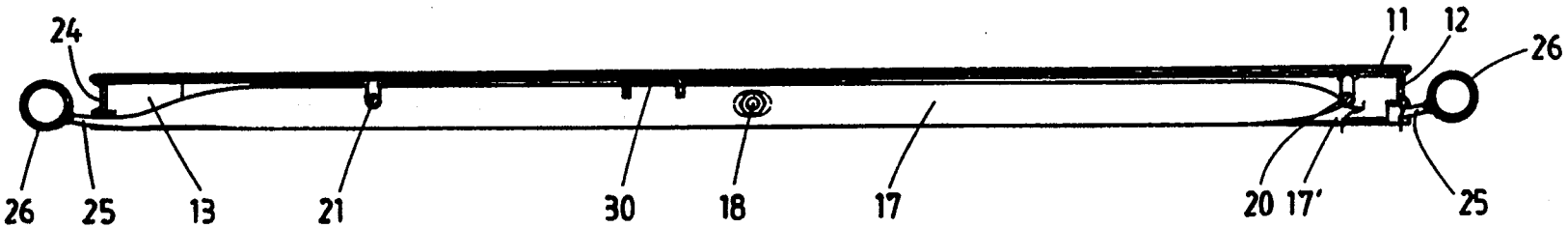
FIG. 2 is a vertical sectional view of the table shown in its fully collapsed condition.
Figure 3:
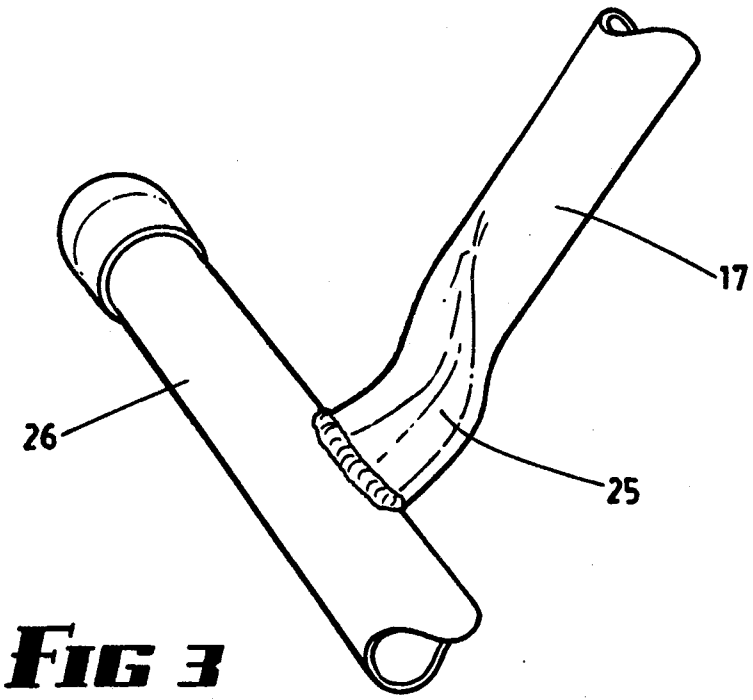
FIG. 3 shows a fragmentary perspective view of the lower end of one of the support legs of the table shown in FIG. 1; whilst

In the embodiment shown in FIGS. 1–3, a collapsible ironing table 10 comprises a flat elongate table top 11 to which is secured a depending peripheral frame or skirt 12 which preferably is a roll-formed sheet metal member of channel cross-sectional shape. The table top 11 comprises a panel of perforate metal material in accordance with known art, and is supported by a pair of spaced apart transversely aligned longitudinally extending intermediate channels 13 joining the ends of the peripheral frame 12, each intermediate channel 13 having a vertical web 14 and a pair of inwardly directed flanges 15 which are directed towards those of the other intermediate channel 13. The channels 13 are roll formed from sheet metal.

The table 10 also comprises a pair of diagonally crossed legs 17, 17' which are pivotally interconnected by a pivot 18 which allows the legs 17 to pivot relative to one another. One of the legs 17 is secured, e.g. by welding, to its upper end a transversely extending leg hinge bar 20 which is carried by and rotates in holes formed in the webs 14 of the intermediate channels 13 near one end of the table top 11.

The other leg 17' is also provided with a leg hinge bar 21 which carries channel engaging slides 22 at its free ends, the slides 22 slidably engaging along the channels 13 during erection and collapsing of the leg assembly (in accordance with known art).

Each of the hinge bars 20, 21 is provided with a kinked portion 23 near one of its ends, the kinked portion forming a recess in which the other leg can locate so that when the table is fully collapsed, the pair of legs 17, 17' lie flat alongside one another in near proximity to the underside of top 11 and have their lower surfaces approximately horizontally aligned with the lower flanges 15 of the channels 13.

Additionally, so that the legs 17, 17' can be collapsed to an approximately coplanar configuration with the table top 11 and its skirt 12 in the space between the channels 13, each end of the peripheral framing member 12 is provided with a recessed portion 24, formed for example by crimping, whilst each of the legs 17, 17' has a flattened portion 25 adjacent its bottom or lower end, the flattened portion 25 being slightly offset with respect to the central longitudinal axis of the leg 17, 17' so as to form a recess which co-operates with a respective recessed portion 24 in the peripheral framing member 12. This allows the legs 17, 17' to lie flat essentially within the confines of the framing member 12 apart from their outer ends which project from respective ends of the top 11.

Each of the flattened portions 25 of the legs 17, 17' is secured, e.g. by welding, to a ground engaging crossbar 26 in a manner so that the leg and the crossbar 26 are approximately coplanar. Thus, when the legs are fully collapsed the crossbars 26 lie outboard of the table top 11, with their underside surfaces approximately flush with the bottom edge surface of the framing member In order to stiffen the construction of the table top 11, a transversely extending channel section bridge member 30 is secured to and extends between the intermediate channels 13 intermediate the ends thereof, the bridge member 30 being provided with cutout or recessed portions 31 in each of its side walls, into which the legs 17, 17' can nest when fully collapsed, to in turn permit the legs to lie flat within the space between the intermediate channels 13. Stiffening wires 33 extending between a respective channel 13 and the peripheral framing member are also provided.

A releasable locking mechanism 36 of known construction is provided for releasably locking the leg assembly in its erected condition.

In the above-described embodiment, whilst the intermediate channels 13 and the peripheral framing member 12 have approximately the same cross-sectional dimensions, and have their bottom flanges lying approximately in a common horizontal plane, it would of course be appreciated that the relative dimensions of those members as well as their relative configuration can vary widely and need not be limited to the configuration shown in the accompanying drawings.

Figure 4:
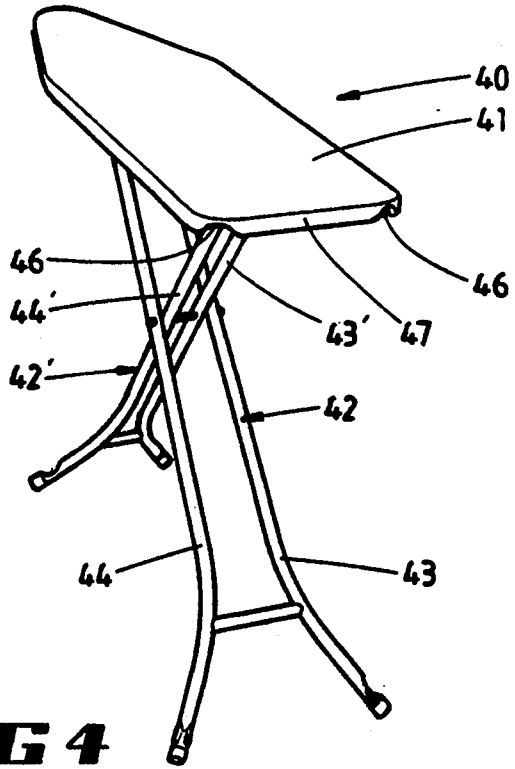
FIG. 4 is a perspective view of an ironing table according to a second embodiment, where table top is supported by four legs instead of two as shown in FIG. 1.

Referring to the embodiment shown in FIG. 4, the table 40 comprises a table top 41 which is supported by a pair of diagonally crossed leg assemblies 42, 42' each leg assembly itself comprising a pair of interconnected legs 43, 44 and 43', 44' which have splayed bottom ends for stability. Each of the legs 43, 44, 43', 44' when fully collapsed, has a portion which locates in a respective recessed or cut-out portion 46 formed in the depending flange 47 which extends around the top 41. The construction of the underside of the top 41 has not been shown but is designed in a manner such that the four legs when fully collapsed, lie flat approximately within the confines of the recessed underside of the top 41, apart from their splayed free end portions which project horizontally outwards from opposite ends of the top 41.

A brief consideration of the above-described embodiment will indicate that the invention provides simple yet very effective improvements to a collapsible ironing table which allow the table to be collapsed to a compact approximately flat configuration in which the legs assume an approximately horizontal position alongside one another nested in the underside of the table top. These improvements enable the table to be far more efficiently packaged and transported, as well as facilitating the carrying of the table by the user to and from its stowed position.

I claim:

1. An ironing table assembly comprising an elongated flat table top having a peripheral depending framing member extending therearound in a direction away from an underside of the table top;

a pair of spaced apart intermediate channels extending longitudinally of said table top and secured to the underside of the table top, said intermediate channels having vertical webs and parallel flanges, the flanges of each channel being in the same planes as and facing the flanges of the other channel; and a pair of diagonally-crossed pivotal support legs supporting the table top and movable between an extended position wherein the legs support the table top in an elevated condition and a retracted out-of-use position wherein the legs occupy a position adjacent the underside of the table top, each said leg having one end secured to a leg hinge member which extends between and is supported by the intermediate channels, with one of said leg hinge members being guided for movement lengthwise along said intermediate channels;

wherein the peripheral framing member, the pivotal support legs and the leg hinge members are shaped, dimensioned and arranged with respect to each other so that the table is collapsible to an approximately flat storage position in which the diagonally crossed pivotal legs assume an approximately horizontal position alongside one another in close proximity to the underside of the table top, with the legs, when thus collapsed, being nested between said intermediate channels, with an outer end portion of each said pivotal leg projecting a short distance beyond a respective end of the table top, and wherein said outer end portion of each said pivotal leg has a reduced thickness leg portion engaging in a recessed portion formed in the peripheral framing member and which extends inwardly from its lower edge, such that each said pivotal leg, when fully collapsed, has its projecting outer end portion approximately horizontally aligned with said peripheral framing member.

2. An ironing table assembly according to claim 1 wherein there are two pivotal support legs, each approximately T-shaped, comprising an elongate leg portion, with one end of said elongate leg portion being secured to a said hinge bar, and another end of said elongate end portion being joined to a horizontal cross bar.

3. An ironing table assembly according to claim 2 wherein each said pivotal support leg itself comprises a pair of transversely aligned leg members, each of the legs having a splayed bottom end.

4. An ironing table assembly comprising an elongated flat table top having a peripheral depending framing member extending therearound in a direction away from an underside of the table top;

a pair of spaced apart intermediate channels extending longitudinally of said table top and secured to the underside of the table top, said intermediate channels having vertical webs and parallel flanges, the flanges of each channel being in the same planes as and facing the flanges of the other channel; and a pair of diagonally-crossed pivotal support legs supporting the table top and movable between an extended position wherein the legs support the table top in an elevated condition and a retracted out-of-use position wherein the legs occupy a position adjacent the underside of the table top, each said leg having one end secured to a leg hinge member which extends between and is supported by the intermediate channels, with one of said leg hinge members being guided for movement lengthwise along said intermediate channels;

wherein the peripheral framing member, the pivotal support legs and the leg hinge members are shaped, dimensioned and arranged with respect to each other so that the table is collapsible to an approximately flat storage position in which the diagonally crossed pivotal legs assume an approximately horizontal position alongside one another in close proximity to the underside of the table top, with the legs, when thus collapsed, being nested between said intermediate channels, wherein each said leg hinge member comprises a hinge bar formed with a kinked portion intermediate the ends of the bar, the kinked portion forming a recess shaped and dimensioned so that each leg, when fully collapsed, has a portion, intermediate its ends, located in a respective said recess forming kinked portion of the hinge bar of the leg hinge member secured to the other leg.

5. An ironing table assembly according to claim 1 wherein each said leg has a flattened leg portion near its unsecured end and which is offset with respect to a central longitudinal axis of the leg, the flattened leg portion, being engageable with a respective said recessed portion on the peripheral framing member so as to allow the leg to assume its approximately flat horizontal disposition when fully collapsed.

6. An ironing table assembly according to claim 1 further comprising a transversely extending channel shaped bridge member secured to and extending between said intermediate channels, intermediate the ends of said intermediate channels said bridge member having aligned cut-out portions in which said legs locate to allow the legs to assume an approximately flat horizontal disposition when fully collapsed.

* * * * *